US008491272B2

(12) United States Patent
Takase

(10) Patent No.: US 8,491,272 B2
(45) Date of Patent: Jul. 23, 2013

(54) PUMPING-OUT APPARATUS AND METHOD FOR PUMPING OUT STORED FLUID

(75) Inventor: Atsuo Takase, Akashi (JP)

(73) Assignee: Heishin Sobi Kabushiki Kaisha, Kobe-shi (JP)

( * ) Notice: Subject to any disclaimer, the term of this patent is extended or adjusted under 35 U.S.C. 154(b) by 229 days.

(21) Appl. No.: 12/596,813

(22) PCT Filed: Apr. 23, 2008

(86) PCT No.: PCT/JP2008/001058
§ 371 (c)(1),
(2), (4) Date: Oct. 20, 2009

(87) PCT Pub. No.: WO2008/132839
PCT Pub. Date: Nov. 6, 2008

(65) Prior Publication Data

US 2010/0129252 A1 May 27, 2010

(30) Foreign Application Priority Data

Apr. 23, 2007 (JP) ..... 2007-112875

(51) Int. Cl.
*F04B 15/02* (2006.01)
*F04B 23/00* (2006.01)
*F04C 2/107* (2006.01)

(52) U.S. Cl.
USPC ..... 417/53; 417/410.3; 222/61

(58) Field of Classification Search
USPC ..... 417/53, 410.3; 222/59, 60, 61
See application file for complete search history.

(56) References Cited

U.S. PATENT DOCUMENTS

| | | | | |
|---|---|---|---|---|
| 4,259,041 | A * | 3/1981 | Brown | 417/559 |
| 4,519,542 | A * | 5/1985 | Johnston | 239/1 |
| 4,651,897 | A * | 3/1987 | Johnson | 222/55 |
| 5,505,781 | A * | 4/1996 | Omori et al. | 118/726 |
| 2007/0039978 | A1 * | 2/2007 | Scheugenpflug | 222/252 |
| 2010/0129252 | A1 * | 5/2010 | Takase | 418/1 |

FOREIGN PATENT DOCUMENTS

| | | | |
|---|---|---|---|
| JP | 03-189376 | | 8/1991 |
| JP | 10218192 | | 8/1998 |
| JP | 2005-133675 | | 5/2005 |
| JP | 2005-133676 | | 5/2005 |
| JP | 2005133676 | A * | 5/2005 |
| JP | 2006-336596 | | 12/2006 |

OTHER PUBLICATIONS

ISA Japanese Patent Office, International Search Report of PCT/JP2008/001058, Jun. 6, 2008, WIPO, 2 pages.

* cited by examiner

*Primary Examiner* — Peter J Bertheaud
*Assistant Examiner* — Dominick L Plakkoottam
(74) *Attorney, Agent, or Firm* — Alleman Hall McCoy Russell & Tuttle LLP

(57) ABSTRACT

A pumping-out apparatus provided herein is configured such that a follow plate is placed on a fluid surface of a stored fluid in a container, a suction port of a pump is attached to an attachment hole of the plate, and the stored fluid is pumped out by the pump. The pumping-out apparatus includes: the pump; a post on which the pump is fixedly provided; a lifted and lowered base on which the container is mounted and which is provided so as to be able to be lifted and lowered along the post; a tension spring configured to hang the lifted and lowered base and bias the lifted and lowered base in an upward direction to cause the fluid surface of the stored fluid in the container to press the plate; and a lifting and lowering operation portion configured to lift and lower an upper end portion of the spring.

5 Claims, 5 Drawing Sheets

PUMPING-OUT APPARATUS AND METHOD FOR PUMPING OUT STORED FLUID

TECHNICAL FIELD

The present invention relates to a pumping-out apparatus capable of pumping up and discharging, using a pump, various liquids and particulate, such as high-viscosity liquids that are pasty or creamy sealing agents, damping agents, ointments, putty agents, and the like and low-viscosity liquids having viscosity similar to water, stored in containers, such as pail cans and drum cans, and a method for pumping out a stored fluid.

BACKGROUND ART

One example of conventional pumping-out apparatuses will be explained in reference to FIGS. 5(*a*), 5(*b*), and 5(*c*). As shown in FIG. 5(*c*), a pumping-out apparatus 1 can suction a liquid 3 stored in a container 2, such as a pail can, using a pump device 4 and supply the suctioned liquid 3 to a predetermined supply destination through a flexible tube 5 and a fixed supply tube 6. As shown in FIGS. 5(*a*) and 5(*b*), the pump device 4 includes a casing 7 having a substantially short cylindrical shape. A lower end portion of the casing 7 is formed as a suction port 7*a*, and an outlet port 7*b* is formed in the vicinity of an upper end portion of the casing 7. The outlet port 7*b* is connected to the fixed supply tube 6 via the flexible tube 5. The pump device 4 is attached to a lifting and lowering device 9 via a bracket 8, and can be lifted and lowered by the lifting and lowering device 9.

When pumping out the liquid 3 in the container 2 using the pumping-out apparatus 1, first, as shown in FIG. 5(*a*), a follow plate 10 is attached to the suction port 7*a* of the pump device 4. Then, the container 2 storing the liquid 3 is placed under the pump device 4 and mounted on a base 11.

Next, as shown in FIG. 5(*b*), the lifting and lowering device 9 is activated to lower the pump device 4 and stops lowering the pump device 4 at a position where a lower surface of the follow plate 10 contacts a liquid surface of the liquid 3 in the container 2. Lifting and lowering of the pump device 4 are carried out by causing a chain 9*a* coupled to the bracket 8 of the pump device 4 to move in a vertical direction.

Next, as shown in FIG. 5(*c*), the bracket 8 is separated from the chain 9*a*, so that the pump device 4 can freely move in the vertical direction along a post 12 of the lifting and lowering device 9. After that, the pump device 4 is activated. When the pump device 4 is activated, it can suction the liquid 3 in the container 2 from the suction port 7*a*, discharge the liquid 3 from the outlet port 7*b*, and supply the liquid 3 through the flexible tube 5 and the fixed supply tube 6 to the predetermined supply destination. As the liquid 3 in the container 2 decreases by pumping-out the liquid 3 using the pump device 4, the pump device 4 and the follow plate 10 are lowered by their own weights and follow the liquid surface. Therefore, substantially the entire liquid 3 in the container 2 can be pumped out by using the pump device 4.

Moreover, although not shown, another example of the conventional pumping-out apparatuses is that unlike the pumping-out apparatus 1 shown in FIG. 5(*c*), when pumping out the liquid 3 in the container 2, the pump device 4 is not separated from the chain 9*a*, and the pump device 4 is lowered by the lifting and lowering device 9 as the liquid surface in the container 2 lowers (see Patent Document 1 for example).

Patent Document 1: Japanese Laid-Open Patent Application Publication 2005-133676

DISCLOSURE OF THE INVENTION

Problems to be Solved by the Invention

However, in the former conventional pumping-out apparatus 1 shown in FIGS. 5(*a*), 5(*b*), and 5(*c*) and the latter conventional pumping-out apparatus, not shown, lifting and lowering of the pump device 4 needs to be carried out when the follow plate 10 attached to the pump device 4 is caused to contact the liquid surface of the liquid 3 in the container 2 and the pumping out is started, when the liquid 3 in the container 2 is being pumped out, and when the pumping-out of the liquid 3 in the container 2 is terminated. Therefore, the flexible tube 5 needs to be connected between the outlet port 7*b* of the pump device 4 and the fixed supply tube 6. Then, in order to prevent a force from being locally applied to the pump device 4 and the flexible tube 5 when lifting and lowering the pump device 4, the flexible tube 5 needs to have an adequate length, and this increases the size of the entire pumping-out apparatus.

Then, in the conventional pumping-out apparatus 1 shown in FIG. 5(*c*), it is necessary that the chain 9*a* be separated from the bracket 8, and the pump device 4 be allowed to freely move in the vertical direction along the post 12 of the lifting and lowering device 9. However, this separating operation is troublesome and requires time and labor. Moreover, if the pumping-out operation is carried out by the pump device 4 without separating the pump device 4 from the chain 9*a*, the pump device 4 cannot be lowered or follow the liquid surface of the liquid 3 in the container 2, and as a result the liquid 3 in the container 2 cannot be pumped out at a predetermined flow rate.

FIG. 5(*c*) shows that the pump device 4 is separated from the lifting and lowering device 9. However, in fact, the pump device 4 is guided by the lifting and lowering device 9 to be able to be lifted and lowered.

Moreover, in the conventional pumping-out apparatus 1 shown in FIG. 5(*c*), since the pump device 4 is separated from the lifting and lowering device 9 when the pump device 4 carries out the pumping-out operation, the weights of the pump device 4 and the flexible tube 5 are applied to the follow plate 10. Therefore, the liquid 3 in the container 2 may leak from a contact portion between an outer peripheral portion of the follow plate 10 and an inner peripheral surface of the container 2, and the leaked liquid 3 may contaminate an upper surface of the follow plate 10 and the suction port 7*a* of the pump device 4.

The present invention was made to solve the above problems, and an object of the present invention is to provide a pumping-out apparatus capable of simplifying a pumping-out operation, preventing a follow plate from being contaminated by leakage of a fluid from a contact portion between the follow plate and a container, and reducing a size thereof, and a method for pumping out a stored fluid.

Means for Solving the Problems

A pumping-out apparatus according to the invention recited in claim 1 is configured such that a follow plate is placed on a fluid surface of a stored fluid stored in a container, a suction port of a pump is attached to an attachment hole of the follow plate, and the stored fluid is able to be pumped up from the suction port and discharged by the pump, and the pumping-out apparatus includes: the pump; a post on which the pump is fixedly provided; a lifted and lowered portion capable of holding the container and provided so as to be able to be lifted and lowered along the post; and a spring, one end of which is coupled to the lifted and lowered portion, and which biases the lifted and lowered portion in an upward direction to cause the fluid surface of the stored fluid in the container to press the follow plate.

In accordance with the pumping-out apparatus according to the invention recited in claim 1, when the stored fluid in the container is pumped out by the pump and the fluid surface of the stored fluid lowers, the weight of the stored fluid in the container decreases, so that the deformation of the spring by the weight of the stored fluid decreases, and the container is lifted. With this, the fluid surface of the stored fluid is maintained at a substantially constant height. Therefore, it is possible to maintain a state in which the follow plate is placed on the fluid surface of the stored fluid in the container, and the suction port of the pump is attached to the attachment hole of the follow plate. Thus, the stored fluid in the container can be continuously pumped out.

Since the pump is fixedly provided on the post, the weight of the pump and the weight of the flexible tube connected to the pump are not applied to the follow plate when the pump is pumping out the stored fluid in the container. Further, since the spring biases the container in the upward direction, the follow plate can be caused to press the fluid surface of the stored fluid in the container by, for example, a substantially constant slight force. In this state, the operation of pumping out the stored fluid in the container using the pump is carried out. In this case, in an entire period from when the pumping-out operation is started to when the pumping-out operation is terminated, the follow plate can be caused to press the fluid surface of the stored fluid in the container by the substantially constant slight force.

This disclosure relates to the following aspects:

1. A pumping-out apparatus configured such that a follow plate is placed on a fluid surface of a stored fluid stored in a container, a suction port of a pump is attached to an attachment hole of the follow plate, and the stored fluid is able to be pumped up from the suction port and discharged by the pump, the pumping-out apparatus comprising:
   the pump;
   a post on which the pump is fixedly provided;
   a lifted and lowered portion capable of holding the container and provided so as to be able to be lifted and lowered along the post; and
   a spring, one end of which is coupled to the lifted and lowered portion, and which biases the lifted and lowered portion in an upward direction to cause the fluid surface of the stored fluid in the container to press the follow plate.
2. The pumping-out apparatus according to aspect 1, wherein the spring is a tension spring, the lifted and lowered portion is hung by the spring, and an upper end of the spring is lifted and lowered by a lifting and lowering operation portion.
3. The pumping-out apparatus according to aspect 2, wherein the pump is a uniaxial eccentric screw pump, a pump device including the uniaxial eccentric screw pump is provided on the post, and the lifting and lowering operation portion is a manual hoisting portion and is provided on the post.
4. The pumping-out apparatus according to aspect 1, wherein the suction port of the pump has a tapered shape which narrows down toward a tip end of the suction port.
5. The pumping-out apparatus according to aspect 1, wherein the spring has a spring constant corresponding to a specific gravity of the stored fluid.
6. A method for pumping out a stored fluid, comprising the steps of:
   placing a follow plate on a fluid surface of a stored fluid stored in a container;
   attaching a suction port of a pump to an attachment hole of the follow plate; and
   pumping up the stored fluid from the suction port and discharging the stored fluid
   by the pump;
   wherein the suction port of the pump is fixedly provided, and the container is biased by a spring in an upward direction to cause the fluid surface of the stored fluid in the container to press the follow plate.
7. The method according to aspect 6, comprising the steps of:
   firstly, placing the follow plate on the fluid surface of the stored fluid in the container;
   secondly, attaching the suction port of the pump to the attachment hole of the follow plate placed on the fluid surface; and
   thirdly, pumping up the stored fluid from the suction port and discharging the stored fluid by the pump.
8. The method according to aspect 6, wherein the spring is a tension spring, the container is hung by the spring, and the spring causes the fluid surface to press the follow plate by a predetermined force.

In the invention recited in aspect 1, the pumping-out apparatus according to the invention recited in aspect 2 is configured such that the spring is a tension spring, the lifted and lowered portion is hung by the spring, and an upper end of the spring is lifted and lowered by a lifting and lowering operation portion.

In accordance with the pumping-out apparatus according to the invention recited in aspect 2, the lifted and lowered portion is hung by the lifting and lowering operation portion via the spring. Therefore, by activating the lifting and lowering operation portion, the lifted and lowered portion can be lowered to a predetermined lower position. When the lifted and lowered portion is located at the predetermined lower position, the lifted and lowered portion can be caused to hold the container storing the stored fluid. Then, by activating the lifting and lowering operation portion, the lifted and lowered portion can be lifted. With this, it is possible to realize a state in which the follow plate is placed on the fluid surface of the stored fluid in the container, and the suction port of the pump is attached to the attachment hole of the follow plate. After that, the pumping-out operation of the stored fluid in the container can be carried out.

The suction port of the pump may be attached to the attachment hole of the follow plate by placing the follow plate on the fluid surface of the stored fluid in the container in advance and lifting the container. Or, the follow plate may be caused to contact the fluid surface of the stored fluid in the container by attaching the follow plate to the suction port of the pump in advance and lifting the container.

Then, when starting the pumping-out operation, the lifting and lowering operation portion lifts the container in the upward direction in a state in which the follow plate is placed on the fluid surface of the stored fluid in the container, and the suction port of the pump is attached to the attachment hole of the follow plate. With this, the follow plate can be set so as to press the fluid surface of the stored fluid by a slight force. The force of pressing the fluid surface of the stored fluid by the follow plate acts as a force applied to a suction force of the pump, and can also act as a force against a frictional force between the outer peripheral portion of the follow plate and the inner peripheral surface of the container during the pumping-out operation.

In the invention recited in aspect 2, the pumping-out apparatus according to the invention recited in aspect 3 is configured such that the pump is a uniaxial eccentric screw pump, a pump including the uniaxial eccentric screw pump is provided on the post, and the lifting and lowering operation portion is a manual hoisting portion and is provided on the post.

In accordance with the pumping-out apparatus according to the invention recited in claim 3, by using the uniaxial eccentric screw pump as the pump, the stored fluid in the container can be efficiently pumped out at a constant flow rate. Then, by attaching the pump to the post, it is possible to provide the pumping-out apparatus which is simple in configuration, requires only a small installation space, and realizes cost reduction, and in which the post does not disturb the pumping-out operation. Moreover, by using the manual hoisting portion as the lifting and lowering operation portion, it is possible to ease the maintenance of the lifting and lowering operation portion as compared to a powered hoisting system, such as an electric hoisting system.

In the invention recited in any one of aspects 1 to 3, the pumping-out apparatus according to the invention recited in aspect 4 is configured such that the suction port of the pump has a tapered shape which narrows down toward a tip end of the suction port.

In accordance with the pumping-out apparatus according to the invention recited in claim 4, for example, when the suction port of the pump is attached to the attachment hole of the follow plate by placing the follow plate on the fluid surface of the stored fluid in the container in advance and lifting the container, the suction port of the pump can be guided by the inner peripheral surface of the attachment hole of the follow plate, and the suction port can be surely and sealingly attached to the attachment hole.

In the invention recited in claim 1, the pumping-out apparatus according to the invention recited in claim 5 is configured such that the spring has a spring constant corresponding to a specific gravity of the stored fluid.

In accordance with the pumping-out apparatus according to the invention recited in claim 5, when the pump is pumping out the stored fluid, the stored fluid in the container decreases, the fluid surface lowers, and the force of pressing the fluid surface of the stored fluid by the follow plate is decreasing. Therefore, since the weight of the stored fluid in the container decreases, the container is lifted by a spring force of the spring, and the force of pressing the fluid surface of the stored fluid by the follow plate increases. On this account, the spring constant is set based on the specific gravity of the stored fluid such that the container can be lifted to recover the lowering of the fluid surface. With this, the force of pressing the fluid surface of the stored fluid by the follow plate during the pumping-out operation can be set to the substantially constant slight force, and the stored fluid can be pumped out at a stable flow rate.

A method for pumping out a stored fluid according to the invention recited in claim 6 includes the steps of: placing a follow plate on a fluid surface of a stored fluid stored in a container; attaching a suction port of a pump to an attachment hole of the follow plate; and pumping up the stored fluid from the suction port and discharging the stored fluid by the pump, wherein the suction port of the pump is fixedly provided, and the container is biased by a spring in an upward direction to cause the fluid surface of the stored fluid in the container to press the follow plate.

In accordance with the method for pumping out the stored fluid according to the invention recited in claim 6, as with the pumping-out apparatus according to claim 1, when the pump is pumping out the stored fluid, the force of pressing the fluid surface of the stored fluid in the container by the follow plate can be set to the substantially constant slight force, and the stored fluid can be pumped out at the stable flow rate regardless of the amount of stored fluid remaining in the container.

In the invention recited in aspect 6, the method for pumping out the stored fluid according to the invention recited in aspect 7 includes the steps of: firstly, placing the follow plate on the fluid surface of the stored fluid in the container; secondly, attaching the suction port of the pump to the attachment hole of the follow plate placed on the fluid surface; and thirdly, pumping up the stored fluid from the suction port and discharging the stored fluid by the pump.

In accordance with the method for pumping out the stored fluid according to the invention recited in aspect 7, before the stored fluid in the container is pumped out, the follow plate can be placed on the fluid surface of the stored fluid in the container in advance. With this, even if air exists between the lower surface of the follow plate and the fluid surface of the stored fluid, it can be removed before the pumping-out operation, and the stored fluid not containing the air can be pumped out and supplied to a desired destination.

In the invention recited in aspect 6 or 7, the method for pumping out the stored fluid according to the invention recited in aspect 8 is configured such that the spring is a tension spring, the container is hung by the spring, and the spring causes the fluid surface to press the follow plate by a predetermined force.

In accordance with the method for pumping out the stored fluid according to the invention recited in aspect 8, as with the pumping-out apparatus according to the invention recited in aspect 2, the fluid surface of the stored fluid can be caused to press the follow plate by the predetermined force. This pressing force acts as a force applied to the suction force of the pump and can also act as the force against the frictional force between the outer peripheral portion of the follow plate and the inner peripheral surface of the container during the pumping-out operation. With this, the stored fluid having comparatively high viscosity can be pumped out.

In accordance with the pumping-out apparatus according to the invention recited in aspect 1 and the method for pumping out the stored fluid according to the invention recited in aspect 6, by fixedly disposing the pump on, for example, the post, the weight of the pump and the weight of the flexible tube connected to the pump are not applied to the follow plate when the pump is pumping out the stored fluid in the container. In addition, the container is biased by the spring in the upward direction to cause the fluid surface of the stored fluid in the container to press the follow plate. Therefore, by setting the spring constant based on the specific gravity of the stored fluid, and the like, the force of pressing the fluid surface of the stored fluid by the follow plate during the pumping-out operation can be set to the substantially constant slight force. On this account, the pressing force of the follow plate with respect to the fluid surface of the stored fluid does not become too strong. As a result, the stored fluid does not contaminate the upper surface of the follow plate and the suction port of the pump by the leakage of the stored fluid in the container from the contact portion between the outer peripheral portion of the follow plate and the inner peripheral surface of the container. Thus, a clean working environment can be realized.

The pump is fixed to the post and is not lifted or lowered. Therefore, when, for example, the flexible tube is connected to the outlet port of the pump, it is unnecessary to form the flexible tube having an adequate length such that the pump can be lifted and lowered. Therefore, since a comparatively short flexible tube can be used, the entire pumping-out apparatus can be comparatively reduced in size.

Moreover, the pumping-out operation can be carried out with the pump fixed to the post. Therefore, it is unnecessary to separate the pump from, for example, a lifting and lowering device each time the pumping-out operation of each container is carried out. Thus, the pumping-out operation can be made simpler than before. Then, since problems do not occur because of not carrying out such separating operation, the stored fluid in the container can be stably pumped out at a predetermined flow rate.

BRIEF DESCRIPTION OF THE DRAWINGS

FIG. 2(*a*) is a partial cross-sectional front view showing that the container is mounted on a lifted and lowered base located at a lower position. FIG. 2(*b*) is a partial cross-sectional front view showing that the lifted and lowered base is lifted, and an attachment hole of a follow plate placed in the container is attached to a suction port of a pump.

FIG. 3(*a*) is a partial cross-sectional front view showing that a part of the stored fluid is pumped out by the pump. FIG. 3(*b*) is a partial cross-sectional front view showing that substantially the entire stored fluid is pumped out by the pump.

FIG. 5(*a*) is a front view showing that the container containing the liquid is placed under a pump device located at an upper position. FIG. 5(*b*) is a front view showing that a lower surface of the follow plate is caused to contact a liquid surface of the liquid in the container by lowering the pump device. FIG. 5(*c*) is a front view showing that the liquid in the container is pumped out by the pump device.

EXPLANATION OF REFERENCE NUMBERS

Figure 1:
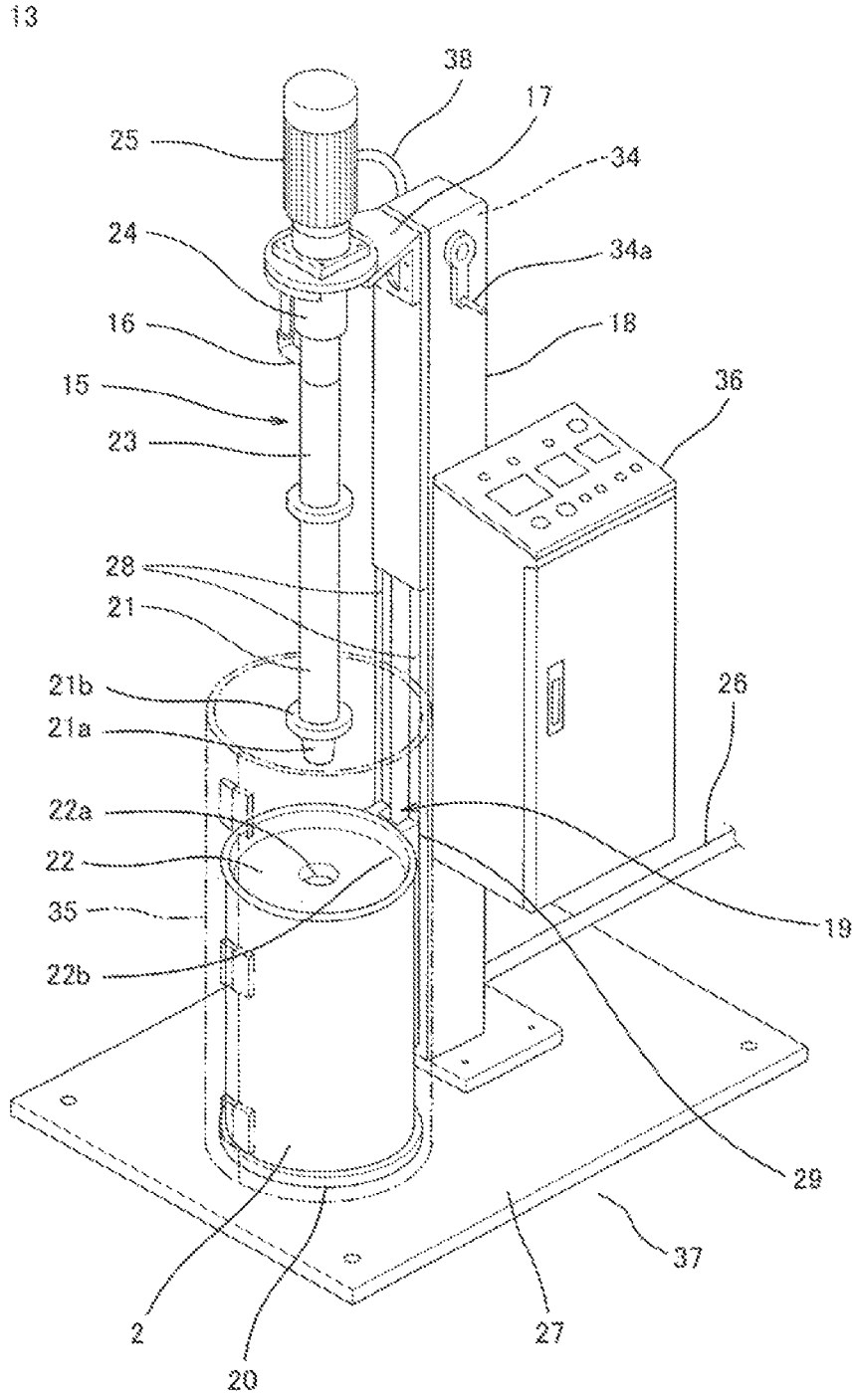
FIG. 1 is a perspective view showing a pumping-out apparatus according to one embodiment of the present invention.

2 container
2*a* inner peripheral surface
13 pumping-out apparatus
14 stored fluid
14*a* fluid surface
15 pump device
16 outlet port
17 bracket
18 post
19 lifting and lowering mechanism
20 lifted and lowered base
21 pump
21*a* suction port
21*b* flange portion
22 follow plate
22*a* attachment hole
22*b* outer peripheral portion
23 pump casing
24 reducer
25 electric motor
26 fixed supply tube
27 base
28 rail
29 slide portion
30 coupling member
31 tension spring
32 hook portion
33 chain
34 lifting and lowering operation portion
34*a* lifting and lowering handle
35 safety cover
36 operation control box
37 floor
38 flexible tube

BEST MODE FOR CARRYING OUT THE INVENTION

Hereinafter, one embodiment of a pumping-out apparatus and a method for pumping out a stored fluid according to the present invention will be explained in reference to FIGS. 1 to 4. A pumping-out apparatus 13 shown in FIG. 1 can use the pumping-out method of the present invention. For example, the pumping-out apparatus 13 can pump up a stored fluid 14 stored in a container 2, such as a pail can or a drum can, using a pump device 15 and discharge the stored fluid 14 from an outlet port 16 at a predetermined flow rate. Examples of the stored fluid 14 are high-viscosity liquids, such as pasty or creamy sealing agents, damping agents, ointments, and putty agents, and low-viscosity liquids having viscosity similar to water. For example, the container 2 is formed in a short cylindrical shape having an upper opening and a bottom portion, and a cross-sectional area D inside the short cylindrical shape at any height is substantially constant.

As shown in FIG. 1, the pumping-out apparatus 13 includes the pump device 15, and the pump device 15 is fixedly attached to an upper end portion of a post 18 via a bracket 17. The post 18 is provided with a lifting and lowering mechanism 19. The lifting and lowering mechanism 19 can lift and lower a lifted and lowered base 20 and the container 2 mounted on the lifted and lowered base 20.

As shown in FIG. 1, the pump device 15 can suction the stored fluid 14 in the container 2 from a suction port 21*a* formed at a lower end portion of a pump 21, and discharge the stored fluid 14 from the outlet port 16 at the predetermined flow rate. A follow plate 22 is detachably attached to the suction port 21*a* of the pump 21, and a pump casing 23 is attached to an upper end portion of the pump 21. A reducer 24 and an electric motor 25 are attached to an upper end portion of the pump casing 23, and the bracket 17 is attached to the reducer 24. The pump device 15 is fixedly attached to the upper end portion of the post 18 via the bracket 17.

Although not shown, the pump 21 is a vertical uniaxial eccentric screw pump, and includes a rotor and a stator. The rotor has an external screw shape, and is rotatably attached to the stator having an inner hole of an internal screw shape. An upper end of the rotor is coupled to a rotating shaft of the reducer 24 via a connecting rod. An upper end portion of the connecting rod is coupled to the rotating shaft of the reducer 24 via a universal joint, and a lower end portion thereof is coupled to the rotor via a universal joint.

As shown in FIG. 1, a fixed supply tube 26 is connected to the outlet port 16 of the pump 21 via a flexible tube 38, such as a hose. The fixed supply tube 26 is fixedly attached to the post 18 along the post 18, and further extends along upper surfaces of a base 27 and a floor 37 to a predetermined supply destination.

As shown in FIG. 1, the lifting and lowering mechanism 19 lifts and lowers the lifted and lowered base 20 on which the container 2 is mounted. The lifting and lowering mechanism 19 includes a pair of rails 28 extending in a vertical direction. The lifted and lowered base 20 is provided on the pair of rails 28 via a slide portion 29 so as to be able to be lifted and lowered. The pair of rails 28 are provided on one post 18, and the base 27 is provided at a lower end portion of the post 18. The base 27 is placed on the floor 37.

Figure 2:
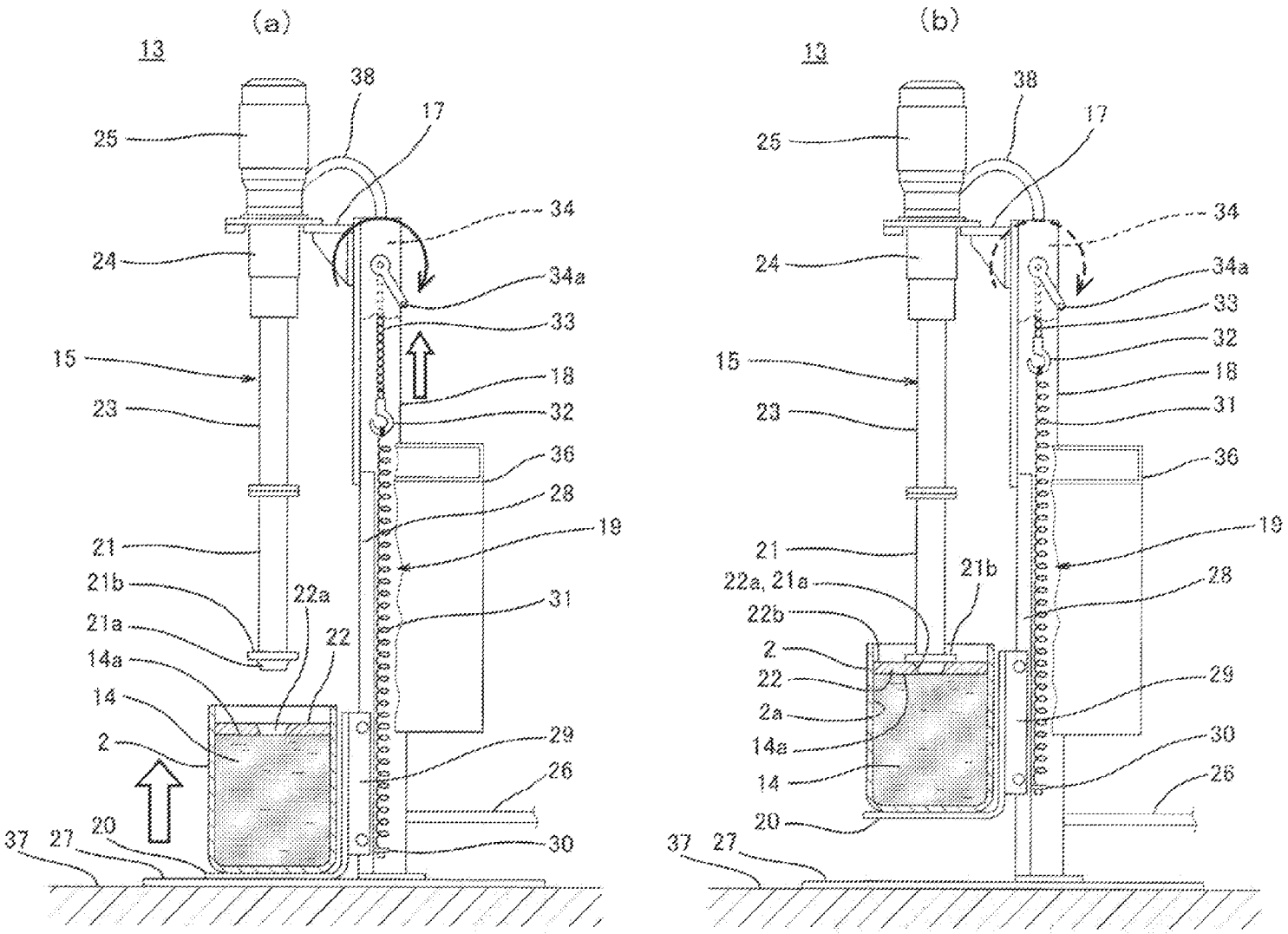
FIG. 2 is a diagram for explaining a procedure of pumping out a stored fluid in a container using the pumping-out apparatus according to the above embodiment.

As shown in FIG. 2(*a*), the slide portion 29 to which the lifted and lowered base 20 is attached is coupled to a lower end portion of a tension spring (tension coil spring) 31 via a coupling member 30, and an upper end portion of the tension spring 31 is coupled to a chain 33 via a hook portion 32. The chain 33 is winded on a lifting and lowering operation portion 34 provided at the upper end portion of the post 18. The lifting and lowering operation portion 34 is a hoisting machine, such as a chain lever hoist. The lifting and lowering operation portion 34 can wind up and down the chain 33 by turning a lifting and lowering handle 34*a* of the lifting and lowering operation portion 34 by an operator. With this, the lifted and lowered base 20 and the container 2 mounted on the lifted and lowered base 20 can be lifted and lowered along the rails 28.

As shown in FIG. 2(*b*), by a turning of the lifting and lowering handle 34*a* by the operator, the lifted and lowered base 20 and the container 2 mounted on the lifted and lowered base 20 can be hung by the lifting and lowering operation portion 34 via the chain 33 and the tension spring 31. Therefore, in this state, as the weight of the stored fluid 14 in the container 2 decreases by pumping out the stored fluid 14 using the pump 21, the spring 31 shortens, so that the lifted and lowered base 20 and the container 2 are automatically lifted along the rails 28.

Further, as shown in FIG. 2(*b*), the suction port 21*a* of the pump 21 is formed to have a tapered shape (inverted cone trapezoidal shape) which narrows down toward a tip end of the suction port 21*a*. An attachment hole 22*a* of the follow plate 22 to which the suction port 21*a* is attached is formed to have a tapered shape (inverted cone trapezoidal shape) corresponding to the shape of the suction port 21*a*.

As shown in FIGS. 2(*a*) and 2(*b*), the follow plate 22 is a substantially circular plate having a certain thickness, and is made of a material capable of floating on the stored fluid 14. For example, the follow plate 22 is made of synthetic resin, such as foamed polyethylene, or a closed cell body of foamed synthetic rubber. The follow plate 22 has flexibility, and has a diameter slightly larger than an inner diameter of the container 2. Therefore, when the follow plate 22 is pressed into and attached to the container 2, a contact portion between an outer peripheral portion 22*b* of the follow plate 22 and an inner peripheral surface 2*a* of the container 2 is sealed. Moreover, a lower surface of the follow plate 22 is a flat surface, and the attachment hole 22*a* is formed at a center portion of the follow plate 22.

As shown in FIG. 2(*a*), when the follow plate 22 is inserted into the container 2 and placed on a fluid surface 14*a* of the stored fluid 14 in the container 2, the air between the lower surface of the follow plate 22 and the fluid surface 14*a* can be discharged through the attachment hole 22*a* to the outside.

As above, an inner peripheral surface of the attachment hole 22*a* has a tapered shape corresponding to the shape of the suction port 21*a* of the pump 21, and the follow plate 22 made of foamed synthetic resin has flexibility. Therefore, when the suction port 21*a* of the pump 21 is attached to the attachment hole 22*a*, the attachment hole 22*a* fits and is detachably coupled to the suction port 21*a*, and this fitting portion is sealed.

As shown in FIG. 2(*b*), in order that the suction port 21*a* of the pump 21 is attached to the attachment hole 22*a* by a predetermined depth, the suction port 21*a* is provided with a flange portion 21*b*. Moreover, as shown in FIG. 1, a safety cover 35 is attached around the lifted and lowered base 20 (the safety cover 35 is not shown in FIGS. 2 to 4.), and an operation control box 36 is attached to the post 18. The operation control box 36 activates and stops the pump device 15.

Next, a procedure of pumping out the stored fluid 14 in the container 2 and supplying the stored fluid 14 through the outlet port 16, the flexible tube 38, and the fixed supply tube 26 to the predetermined supply destination using the pumping-out apparatus 13 configured as shown in FIGS. 1 and 2 will be explained. First, as shown in FIGS. 1 and 2, the operator places the follow plate 22 on the fluid surface 14*a* of the stored fluid 14 in the container 2. The follow plate 22 is attached to the container 2 before the container 2 is attached to the pumping-out apparatus 13, i.e., follow plate 22 is attached to the container 2 when the suction port 21*a* of the pump 21 is not yet attached to the attachment hole 22*a* of the follow plate 22. The follow plate 22 has flexibility, and has a diameter slightly larger than the inner diameter of the container 2. Therefore, when the follow plate 22 is pressed into and attached to the container 2, the follow plate 22 elastically deforms, so that the contact portion between the outer peripheral portion 22*b* and the inner peripheral surface 2*a* of the container 2 is sealed.

In this state, by further pressing the follow plate 22 into the container 2, the air between the lower surface of the follow plate 22 and the fluid surface 14*a* of the stored fluid 14 in the container 2 can be discharged through the attachment hole 22*a* to the outside. Thus, as shown in FIG. 2(*a*), the follow plate 22 can be placed on the fluid surface 14*a* without the air between the lower surface of the follow plate 22 and the fluid surface 14*a*. At this time, the follow plate 22 is pressed into the container 2 until the stored fluid 14 flows into the attachment hole 22*a*.

Next, as shown in FIGS. 1 and 2(*a*), the operator places the container 2, to which the follow plate 22 is attached, on the lifted and lowered base 20 of the pumping-out apparatus 13. Before the operator places the container 2 on the lifted and lowered base 20, he or she turns the lifting and lowering handle 34*a* to lower the lifted and lowered base 20 to a predetermined lower position.

Then, as shown in FIG. 2(*b*), the operator turns the lifting and lowering handle 34*a* to lift the lifted and lowered base 20 on which the container 2 is mounted, and causes the suction port 21*a* of the pump 21 to be attached to the attachment hole 22*a* of the follow plate 22. In a state where the suction port 21*a* of the pump 21 is attached to the attachment hole 22*a*, the operator further turns the lifting and lowering handle 34*a* a predetermined number of times in the same direction. With this, it is possible to set a state in which the follow plate 22 presses the fluid surface 14*a* of the stored fluid 14 by a predetermined force. As above, by causing the follow plate 22 to press the fluid surface 14*a* by the predetermined force, as described below, a suction force of the pump 21 can be improved, and the stored fluid 14 having comparatively high viscosity can be pumped out from the container 2.

Figure 3:
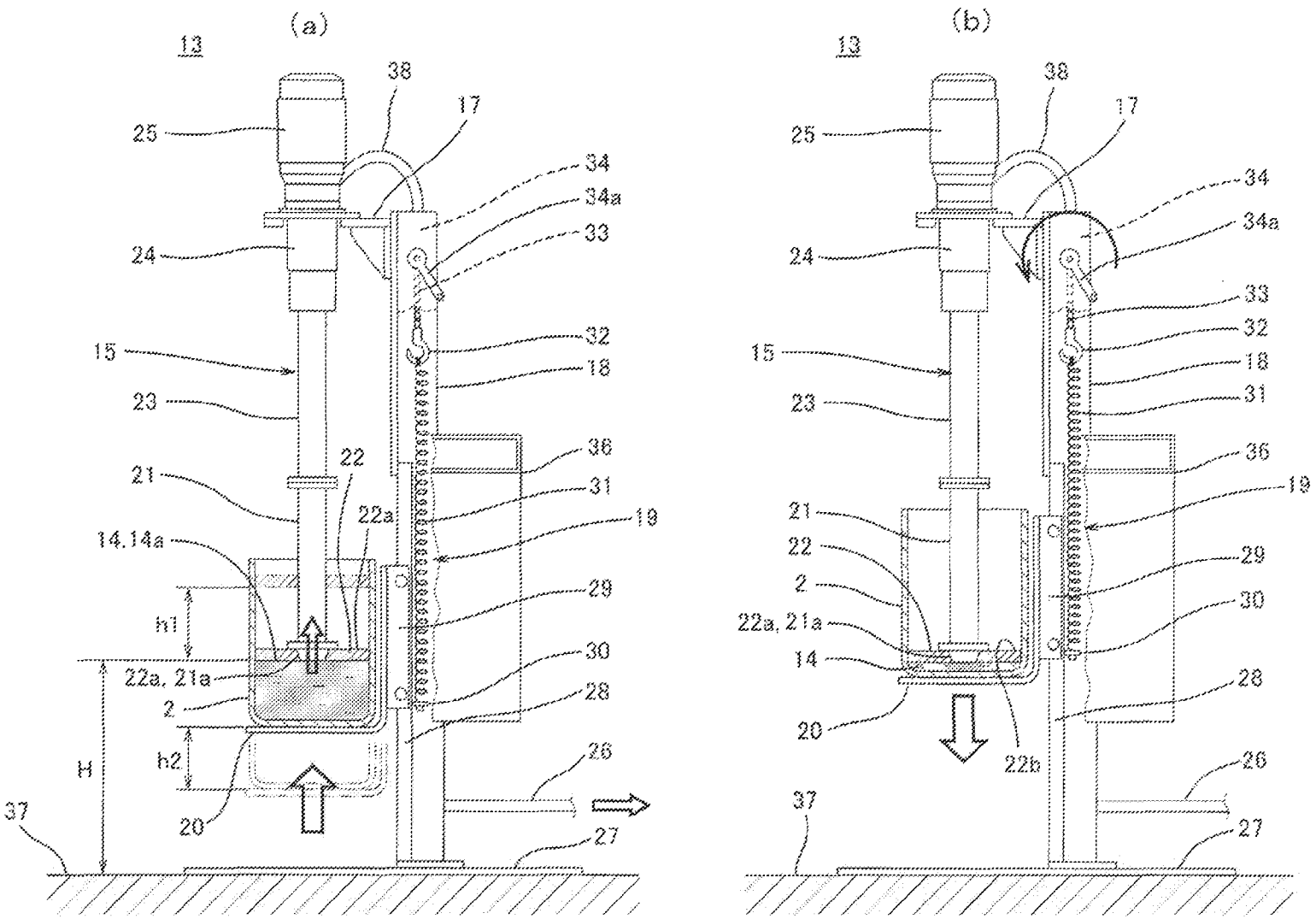
FIG. 3 is a diagram for explaining a procedure of pumping out the stored fluid in the container using the pumping-out apparatus according to the above embodiment.
Figure 4:
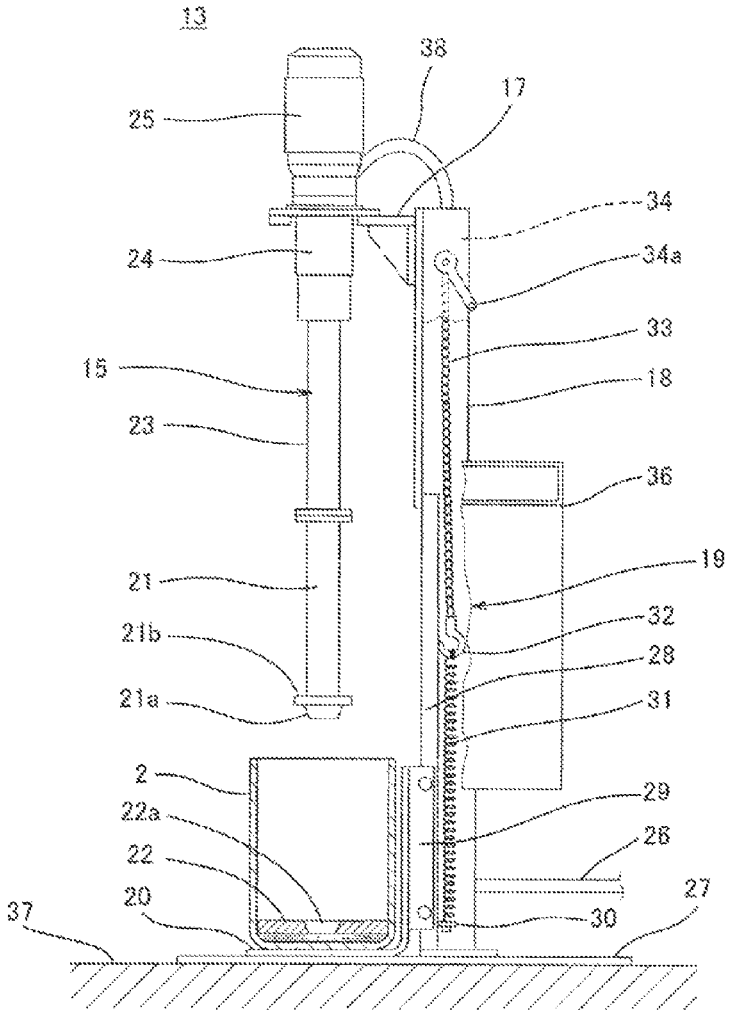
FIG. 4 is a partial cross-sectional front view showing that the lifted and lowered base is lowered to the lower position after a stored liquid in the container is pumped out using the pumping-out apparatus according to the above embodiment.
Figure 5:
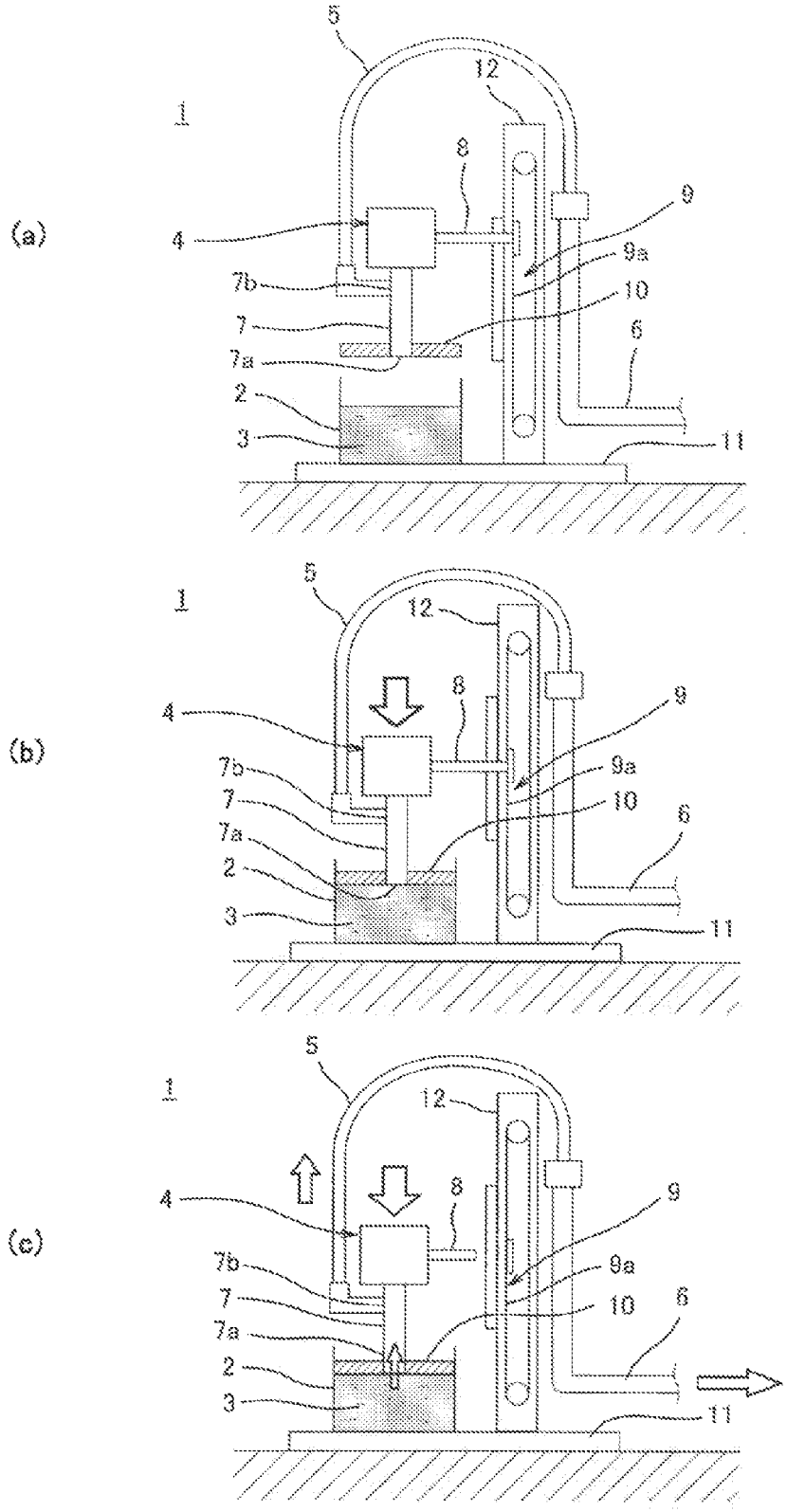
Fig. 5 Prior Art
FIG. 5 is a diagram for explaining a procedure of pumping out the stored liquid in the container using the conventional pumping-out apparatus.

Next, the pump device 15 is activated. With this, as shown in FIG. 3(*a*), the pumping-out apparatus 13 can suction the stored fluid 14 in the container 2 from the suction port 21*a* of the pump 21, discharge the stored fluid 14 from the outlet port 16, and supply the stored fluid 14 through the flexible tube 38 and the fixed supply tube 26 to the predetermined supply destination. At this time, since the air does not exist under the lower surface of the follow plate 22, the stored fluid 14 suctioned by the pump 21 does not contain the air. Therefore, the stored fluid 14 can be surely discharged from the outlet port 16 of the pump 21 at the predetermined flow rate.

As shown in FIG. 3(*a*), when the stored fluid 14 in the container 2 is being pumped out using the pump 21, as described below, the container 2 is lifted by a spring force and the suction force of the pump 21 as the fluid surface 14*a* of the stored fluid 14 in the container 2 lowers. Therefore, it is possible to maintain a state in which during the pumping-out operation, the follow plate 22 is placed on the fluid surface 14*a* of the stored fluid 14 in the container 2, and the suction port 21*a* of the pump 21 is attached to the attachment hole 22*a* of the follow plate 22. Thus, the stored fluid 14 in the container 2 can be continuously pumped out. In addition, a force of pressing the fluid surface 14*a* of the stored fluid 14 in the container 2 by the follow plate 22 can be set to be substantially constant, as described below. Therefore, the stored fluid 14 can be pumped out at a stable flow rate.

Next, as shown in FIG. 3(*b*), when the stored fluid 14 in the container 2 decreases, and the amount of the stored fluid 14 has become a predetermined amount slightly larger than the amount of the stored fluid 14 which cannot be pumped up at the predetermined flow rate, this consumed container 2 is replaced with a new container 2 in which a defined amount of the stored fluid 14 is stored.

To be specific, as shown in FIGS. 3(*b*) and 4, the operator operates the lifting and lowering handle 34*a* of the lifting and lowering operation portion 34 to lower the lifted and lowered base 20 and separate the attachment hole 22*a* of the follow plate 22 from the suction port 21*a* of the pump 21. Then, the consumed container 2 having the follow plate 22 is detached from the lifted and lowered base 20, and the new container 2 in which the defined amount of the stored fluid 14 is stored is mounted on the lifted and lowered base 20. As shown in FIGS. 1 and 2(*a*), the follow plate 22 is attached to the new container 2 in advance.

Next, as shown in FIGS. 2(*b*), 3(*a*), and 3(*b*), by carrying out the same procedure as above, the attachment hole 22*a* of the follow plate 22 can be attached to the suction port 14*a* of the pump 21, and the stored fluid 14 in the container 2 can be pumped out using the pump 21 and discharged from the outlet port 16 at the predetermined flow rate.

Next, the actions of the pumping-out apparatus 13 and the method for pumping out the stored fluid 14 according to the embodiment will be explained in reference to FIGS. 1 to 4. For example, as shown in FIG. 3(*a*), when the stored fluid 14 in the container 2 is pumped out using the pump 21, and the height of the fluid surface 14*a* of the stored fluid 14 is lowered by h1, the weight of the stored fluid 14 in the container 2 is decreased by G (=γ (specific weight)×D (cross-sectional area in the container 2)×h1 (decreased height of the fluid surface 14*a*)). Therefore, the length of the spring 31 shortens by h2 in proportion to the decreased weight G of the stored fluid 14, so that the container 2 is lifted by h2.

Here, in the present embodiment, a spring constant k is set such that h1 (decreased height of the fluid surface 14*a*) becomes equal to h2 (lifted amount of the container 2). To be specific, the spring constant k is calculated as below.

$$\text{Spring Constant } k=\gamma\times D\times h1/h2=\gamma\times D \quad (1)$$

With this, a height H of the fluid surface 14*a* of the stored fluid 14 in the container 2 from the floor 37 is maintained substantially constant. Therefore, it is possible to maintain a state in which the follow plate 22 is placed on the fluid surface 14*a* of the stored fluid 14 in the container 2, and the suction port 21*a* of the pump 21 is attached to the attachment hole 22*a* of the follow plate 22. Thus, the stored fluid 14 in the container 2 can be continuously pumped out at a stable flow rate.

Therefore, when changing the specific weight γ of the stored fluid 14 and/or the cross-sectional area D inside the container 2, the spring constant k corresponding to such change may be calculated by Formula (1), the spring having such spring constant k may be set, and the pumping-out operation may be carried out.

As shown in FIG. 3(*a*), when the pump 21 is pumping out the stored fluid 14 in the container 2, the follow plate 22 can be caused to press the fluid surface 14*a* of the stored fluid 14 in the container 2 by a substantially constant force.

To be specific, as shown in FIG. 2(*b*), the operator turns the lifting and lowering handle 34*a* to lift the container 2 and cause the attachment hole 22*a* of the follow plate 22 to contact the suction port 21*a* of the pump device 15. In this state, the operator further turns the lifting and lowering handle 34*a* the predetermined number of times in the same direction. With this, it is possible to set a state in which the follow plate 22 presses the fluid surface 14*a* of the stored fluid 14 in the container 2 by the predetermined force. In this state, as shown in FIG. 3(*a*), the operation of pumping out the stored fluid 14 in the container 2 using the pump 21 is carried out. In this case, in an entire period from when the pumping-out operation is started to when the pumping-out operation is terminated as shown in FIG. 3(*b*), the follow plate 22 can be caused to press the fluid surface 14*a* of the stored fluid 14 in the container 2 by a substantially constant predetermined force.

The force of downwardly pressing the fluid surface 14*a* of the stored fluid 14 by the follow plate 22 acts as a force applied to the suction force of the pump 21, and can also act as a force against a frictional force between the outer peripheral portion 22*b* of the follow plate 22 and the inner peripheral surface 2*a* of the container 2 during the pumping-out operation. With this, the stored fluid 14 having comparatively high viscosity can be pumped out from the container 2 at the stable flow rate.

Then, during the pumping-out operation, the follow plate 22 can be caused to downwardly press the fluid surface 14*a* of the stored fluid 14 by an appropriate predetermined constant force. Therefore, the pressing force of the follow plate 22 with respect to the fluid surface 14*a* of the stored fluid 14 does not become too strong. On this account, the stored fluid 14 does not contaminate the upper surface of the follow plate 22 and the suction port 21*a* of the pump device 15 by the leakage of the stored fluid 14 in the container 2 from the contact portion between the outer peripheral portion 22*b* of the follow plate 22 and the inner peripheral surface 2*a* of the container 2. Thus, a clean working environment can be realized.

As shown in FIG. 3(*a*), the present embodiment is configured such that: the pump 21 is fixedly provided on the post 18, so that the weight of the pump 21 and the weight of the flexible tube 38 connected to the pump 21 are not applied to the follow plate 22 when the pump 21 is pumping out the stored fluid 14 in the container 2; and the container 2 is biased by the spring 31 in an upward direction to cause the fluid surface 14*a* of the stored fluid 14 in the container 2 to press the follow plate 22. Therefore, in FIG. 2(*b*), the lifting and lowering handle 34*a* is operated and adjusted such that the follow plate 22 and the fluid surface 14*a* contact each other by a slight force, and in this state, the pumping-up operation can be carried out. With this setting, the pumping-out operation can be carried out in a state in which the follow plate 22 is pressing the fluid surface 14*a* of the stored fluid 14 in the container 2 by a substantially constant slight force.

As shown in FIG. 1, the pump device 15 is fixedly attached to the post 18 and is not lifted along the post 18. Therefore, even if the flexible tube 38 is connected to the outlet port 16 of the pump 21, it is unnecessary to use the adequately long flexible tube 38 such that the pump 21 can be lifted. Therefore, since the comparatively short flexible tube 38 can be used, the entire pumping-out apparatus 13 can be comparatively reduced in size.

Further, as shown in FIGS. 1 to 4, the pumping-out operation can be carried out with the pump device 15 fixedly attached to the post 18. Therefore, it is unnecessary to separate the pump 21 from, for example, the lifting and lowering mechanism 19 each time the pumping-out operation of each container 2 is carried out. On this account, the pumping-out operation can be more easily carried out than before. Then, problems do not occur although such separating operation is not carried out. Therefore, the stored fluid 14 in the container 2 can be stably pumped out at the predetermined flow rate.

In accordance with the pumping-out apparatus 13 shown in FIG. 1, by using a uniaxial eccentric screw pump as the pump 21, the stored fluid 14 in the container 2 can be efficiently pumped out at a constant flow rate. Then, by configuring the pumping-out apparatus 13 using one post 18, it is possible to provide the pumping-out apparatus 13 which is simple in configuration, requires only a small installation space, and realizes cost reduction, and in which the post 18 does not disturb the pumping-out operation. Moreover, by using a manual hoisting machine as the lifting and lowering operation portion 34, it is possible to ease the maintenance of the lifting and lowering operation portion 34.

As shown in FIGS. 2(*a*) and 2(*b*), the suction port 21*a* of the pump 21 is formed to have a tapered shape which narrows down toward a tip end of the suction port 21*a*. With this, for example, when the suction port 21*a* of the pump 21 is attached to the attachment hole 22*a* of the follow plate 22 by placing the follow plate 22 on the fluid surface 14*a* of the stored fluid 14 in the container 2 in advance and lifting the container 2, the suction port 21*a* of the pump 21 can be guided by the inner peripheral surface of the attachment hole 22*a* of the follow plate 22, and the suction port 21*a* can be surely and sealingly attached to the attachment hole 22*a*. Therefore, the pumping-out operation of the stored fluid 14 can be accurately carried out.

In the embodiment, as shown in FIGS. 1 to 3, the follow plate 22 is placed on the fluid surface 14*a* of the stored fluid 14 in the container 2 in advance, and the container 2 is then lifted to cause the suction port 21*a* of the pump 21 to be attached to the attachment hole 22*a* of the follow plate 22. However, instead of this, although not shown, the follow plate 22 may be attached to the suction port 21*a* of the pump 21 in advance, and the container 2 may be then lifted to cause the follow plate 22 to contact the fluid surface 14*a* of the stored fluid 14 of the container 2.

In the above embodiment, as shown in FIGS. 2(*a*) and 2(*b*), the lifted and lowered base 20 is biased in the upward direction by using the tension spring 31. However, instead of the tension spring 31, a compression spring may be used to bias the lifted and lowered base 20 in the upward direction. To be specific, in a state in which the stored fluid 14 is stored in the container 2, the compression spring is compressed by the weight of the stored fluid 14, and the container 2 is maintained at a height shown in FIG. 2(*b*). Then, the spring constant of the compression spring is set such that as the stored fluid 14 in the container 2 is pumped out by the pump 21 and decreases, the compression spring stretches by the decrease in weight of the stored fluid 14 in the container 2, and the container 2 is lifted to the height shown in FIGS. 3(*a*) and 3(*b*).

In the above embodiment, as shown in FIGS. 2(*a*) and 2(*b*), the contact portion between the outer peripheral portion 22*b* of the follow plate 22 and the inner peripheral surface 2*a* of the container 2 is sealed. However, instead of this, the contact portion may be formed such that the outer peripheral portion 22*b* of the follow plate 22 can scrape off the stored fluid 14 adhered to the inner peripheral surface 2*a* of the container 2. Moreover, the follow plate configured such that a gap is formed between the outer peripheral portion 22*b* of the follow plate 22 and the inner peripheral surface 2*a* of the container 2 may be used.

Further, in the above embodiment, as shown in FIGS. 2(*a*) and 2(*b*), the lifting and lowering mechanism 19 which is manually operated by the operator was exemplified. However, instead of this, for example, the lifted and lowered base 20 may be lifted and lowered by an electric motor or a hydraulic or pneumatic driving portion.

In the above embodiment, as shown in FIG. 1, the fixed supply tube 26 is connected to the outlet port 16 of the pump 21 via the flexible tube 38, such as a hose. However, instead of this, the fixed supply tube 26 may be directly connected to the outlet port 16 of the pump 21.

INDUSTRIAL APPLICABILITY

As above, the pumping-out apparatus and the method for pumping out the stored fluid according to the present invention have excellent effects of being able to simplify the pumping-out operation, prevent the follow plate from being contaminated by the leakage of the fluid from the contact portion between the follow plate and the container, and reduce the size of the pumping-out apparatus. Therefore, the present invention is suitable for application to such pumping-out apparatus and method for pumping out a stored fluid.

The invention claimed is:

1. A pumping-out apparatus, comprising:

a pump;

a follow plate that is placed on a fluid surface of a stored fluid stored in a container, a suction port of the pump being attached to an attachment hole of the follow plate, and the stored fluid being able to be pumped up from the suction port and discharged by the pump;

a post on which the pump is fixedly provided;

a lifted and lowered portion capable of holding the container and provided so as to be able to be lifted and lowered along the post; and a spring, one end of which is coupled to the lifted and lowered portion, and which biases the lifted and lowered portion in an upward direction to cause the fluid surface of the stored fluid in the container to press the follow plate, and wherein a lifting and lowering handle is operatively coupled to the lifted and lowered portion to raise and lower the lifted and lowered portion, wherein the spring is set such that when the stored fluid in the container is pumped up by the pump and a weight of the stored fluid in the container decreases, the container is lifted solely by a biasing force of the spring, and the fluid surface of the stored fluid is caused to press the follow plate by a substantially constant predetermined force; and the spring is a tension spring, the lifted and lowered portion is hung by the spring, and an upper end of the spring is lifted and lowered by the lifting and lowering operation portion, wherein the spring constant k of the spring is calculated according to the formula:

$k=\gamma\times D;$ where γ=specific weight of the stored fluid, and where D=cross-sectional area of the container; and wherein the lifted and lowered portion may be lifted and/or lowered via the handle to selectively increase or decrease the biasing force exerted by the spring and the resultant substantially constant predetermined force exerted by the fluid surface on the follow plate; and wherein the follow plate and fluid surface are maintained at substantially the same height while the lifted and lowered portion is lifted as the pump pumps the stored fluid out of the container, and the weight of the container decreases, causing the container to be lifted by the spring, while maintaining the substantially constant predetermined force on the follow plate.

2. The pumping-out apparatus according to claim 1, wherein the pump is a uniaxial eccentric screw pump, a pump device including the uniaxial eccentric screw pump is provided on the post, and the lifting and lowering operation portion is a manual hoisting portion and is provided on the post.

3. The pumping-out apparatus according to claim 1, wherein the suction port of the pump has a tapered shape which narrows down toward a tip end of the suction port.

4. The pumping-out apparatus according to claim 1, wherein the spring has a spring constant corresponding to a specific gravity of the stored fluid.

5. A method for pumping out a stored fluid, comprising the steps of:

placing a follow plate on a fluid surface of a stored fluid stored in a container;

attaching a suction port of a pump to an attachment hole of the follow plate; and pumping up the stored fluid from the suction port and discharging the stored fluid by the pump;

wherein the suction port of the pump is fixedly provided, and the container is biased by a spring in an upward direction to cause the fluid surface of the stored fluid in the container to press the follow plate;

the spring is set such that when the stored fluid in the container is pumped up by the pump and a weight of the stored fluid in the container decreases, the container is lifted solely by a biasing force of the spring, and the fluid surface of the stored fluid is caused to press the follow plate by a substantially constant predetermined force;

the spring is a tension spring, a lifted and lowered portion is hung by the spring, wherein a lifting and lowering handle is operatively coupled to the lifted and lowered portion to raise and lower the lifted and lowered portion, and an upper end of the spring is lifted and lowered by the lifting and lowering handle, wherein the spring constant k of the spring is calculated according to the formula:

$k=\gamma\times D;$ where γ=specific weight of the stored fluid, and where D=cross-sectional area of the container; and wherein the lifted and lowered portion may be lifted and/or lowered via the handle to selectively increase or decrease the bias force exerted by the spring and the resultant substantially constant predetermined force exerted by the fluid surface on the follow plate; and wherein the follow plate and fluid surface are maintained at substantially the same height while the lifted and lowered portion is lifted as the pump pumps the stored fluid out of the container, and the weight of the container decreases, causing the container to be lifted by the spring, while maintaining the substantially constant predetermined force on the follow plate.

* * * * *